United States Patent [19]

Martin

[11] Patent Number: 4,920,764

[45] Date of Patent: May 1, 1990

[54] REFRIGERATION UNIT FOR VENDING MACHINES

[76] Inventor: Ernest N. Martin, 26937 N. Broadway, Escondido, Calif. 92026

[21] Appl. No.: 333,013

[22] Filed: Apr. 4, 1989

[51] Int. Cl.[5] ..... F25D 23/12

[52] U.S. Cl. ..... 62/259.1; 62/DIG. 16; 221/150 R

[58] Field of Search ..... 62/DIG. 16, 259.1; 221/150 R

[56] References Cited

U.S. PATENT DOCUMENTS

| | | | |
|---|---|---|---|
| 3,031,862 | 5/1962 | Sherron | 62/259.1 |
| 3,415,073 | 12/1968 | Ammons | 62/259.1 |
| 3,417,576 | 12/1968 | Stucky | 62/259.1 X |
| 4,593,752 | 6/1986 | Tipton | 62/503 X |

*Primary Examiner*—Lloyd L. King

*Attorney, Agent, or Firm*—Georges A. Maxwell

[57] ABSTRACT

A refrigeration unit for coin-operated, food item vending machines having box-like metal cabinets with substantially flat, vertical front panels; substantially flat, horizontal top panels; coin mechanisms within the cabinets; food item supporting, transporting and dispensing mechanisms within the cabinets; item selecting and operating mechanisms; and, item discharge ducts extending through and accessible at the exterior of said front panels. The refrigeration unit operates to recirculate and cool the air within the cabinets and to maintain food items therein at desired, safe, low temperatures. The refrigeration unit includes a horizontal, downwardly opening box-like base supported atop the top panel of a related machine with said top panel closing the bottom thereof. The base has a vertical partition extending transverse its interior and defining a downwardly opening air delivery chamber and a downwardly opening air return chamber. The top panel has one or more air delivery ports and one or more air return ports communicating with the delivery and return chambers and selectively positioned in the top panel to most effectively and efficiently circulate air flowing from the delivery chamber throughout the interior of the cabinet and then into the return chamber. The refrigeration unit next includes a thermally insulated case supported by the base. The base has an evaporator coil unit with an air moving fan extending transverse the interior of the case and defining air intake and outlet compartments therein. The base has air intake and air outlet openings establishing communication between the air intake compartment and return chamber and between the air outlet compartment and delivery chamber.

9 Claims, 3 Drawing Sheets

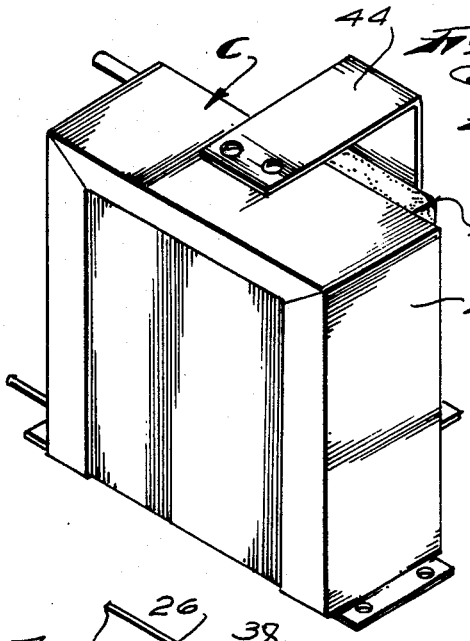
Fig. 10.
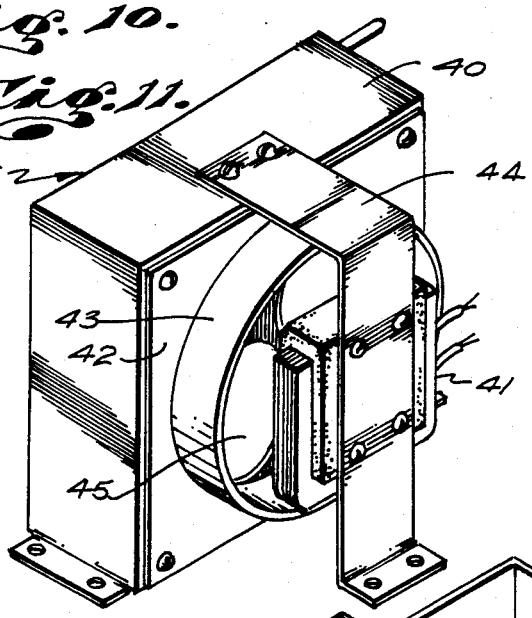
Fig. 11.
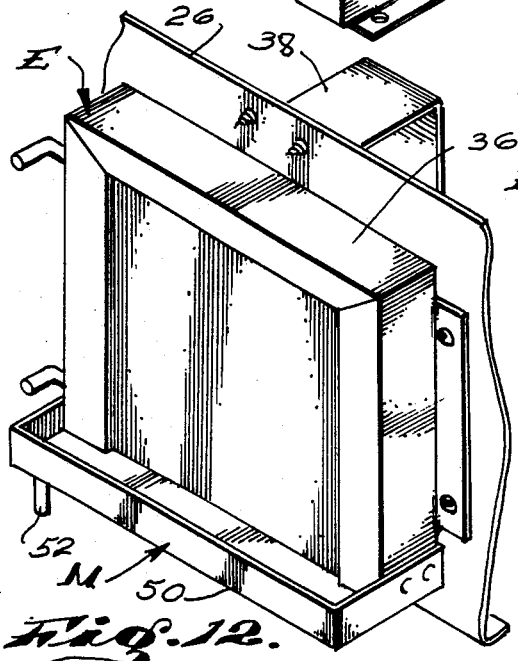
Fig. 12.
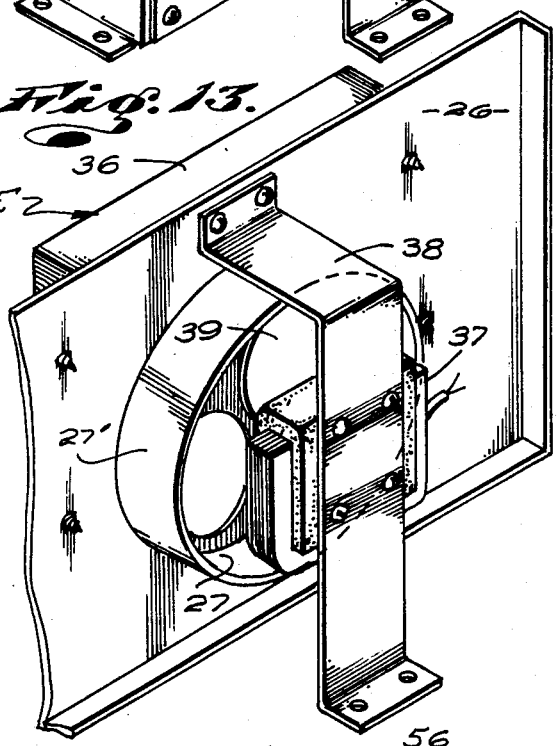
Fig. 13.
Fig. 14.
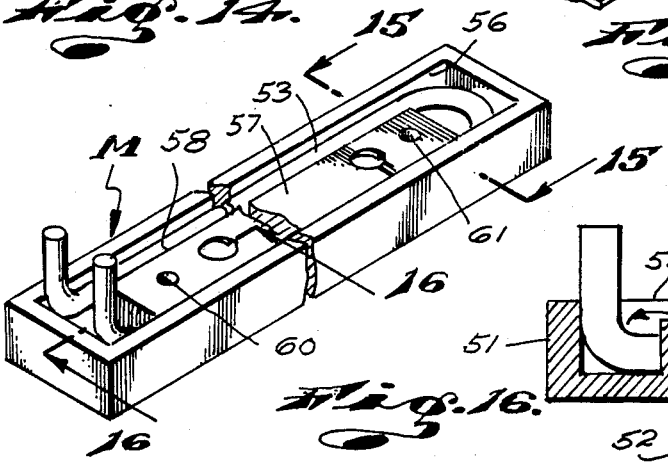
Fig. 15.
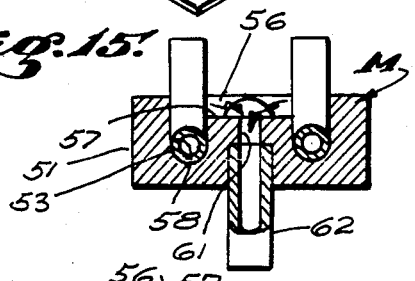
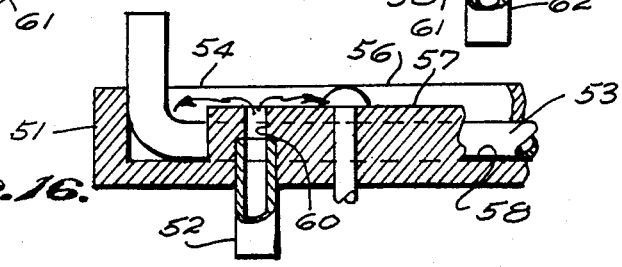
Fig. 16.

REFRIGERATION UNIT FOR VENDING MACHINES

PRIOR ART

The U.S. Patents listed below are the most pertinent prior art of which I am aware.

U S. Pat. No. 2,604,371, issued July, 22, 2952 to E. H Smiley et al for "Apple Vending Machine". This patent discloses a vending machine with a refrigeration system built into it.

U.S. Pat. No. 2,671,000, issued Mar. 2, 1954 to F. A. Ossanna, Jr. for "Temperature Controlled Vending Cabinet". This patent teaches a vending machine with a refrigeration system built into it.

U.S. Pat. No. 2,914,927, issued Dec. 1, 1959 to S. S. Corhandis for "Detachable Refrigerating Unit". This patent discloses a refrigeration unit releasably attached to the exterior of a storage cabinet designed and constructed to accommodate the unit.

U.S. Pat. No. 2,963,883, issued Dec. 13, 1960 to C. H. Teesdale for "Ice Cream Vendor". This patent teaches a vending machine with a refrigeration system built into it.

U.S. Pat. No. 3,010,556, issued Nov. 28, 1961 to W. J. Wawrzonek et al for "Refrigeration Food Vendor". This patent teaches a vending machine with a refrigeration system built into it.

U.S. Pat. No 3,087,649, issued Apr. 30, 1963 to R. R. Leonard et al for "Refrigerated-Sandwich Merchandising Machine". This patent teaches a vending machine with a refrigeration system built into it.

U.S. Pat. No. 3,433,031, issued Mar. 18, 1969 to T. G. Scheitlin et al for "Removable Unitary Refrigeration System". This patent discloses a novel vending machine and refrigeration system unit in which the refrigeration system can be removed from within the vending machine.

U.S. Pat. No. 3,712,078, issued Jan. 23, 1973 to James G. Maynard et al for "Refrigeration Unit". This patent discloses a refrigeration unit and related vending machine wherein the unit is removable from within the machine.

U.S. Pat. No. 2,604,371, issued July 22, 1952 for "Apple Vending Machine". This patent discloses a machine with a refrigeration system built into it.

BACKGROUND OF THE INVENTION

In the art of coin-operated vending machines, there exists hundreds of thousands of machines particularly suited for vending a wide variety of food items but which are not provided with cooler or refrigeration means which enables them to handle and vend temperature-sensitive or perishable food items that must be maintained at or below a safe temperature; for example, about 70° F. Such machines are, therefore, only capable of vending non-temperature sensitive or durable food items that can be safely subjected to temperatures substantially greater than 70° F. and/or can only be used to vend temperature-sensitive, perishable or delicate food items during cold seasons or in cold environments where the ambient temperatures to which the machines are subjected is unlikely to exceed 70° F.

As a result of the above, vending of food items in and by the vast majority of vending machines that do not include refrigeration means is materially limited and both the services to be offered and the profits to be earned by those who operate and service those machines are notably adversely affected. Accordingly, there has been a long-recognized want and need for refrigerated vending machines.

The prior art has sought to satisfy the above-noted want and need for refrigerated vending machines that are capable of vending a vast number of different temperature-sensitive or delicate food items by constructing vending machines with refrigeration systems built into them. For many vending machine operators to adopt and use costly refrigerated machines in place of their existing or old, non-refrigerated machines would require that they scrap or otherwise dispose of their old machines. Few vending machine operators are capable and/or willing to make the capital investment that would be incurred to replace their old machines with new refrigerated machines.

To my knowledge and belief, some persons, in the past, have sought to develop refrigeration systems that could be related to old or existing non-refrigerated vending machines but have met with little or no success. The reason such past efforts by others have failed to bring about satisfactory results resides in the fact that they have required excessive modification and/or customizing of the old machines. That modification and/or customizing of old machines, in addition to being excessively costly, has all too often resulted in unsightly assemblages which have proved to be totally unacceptable.

Other past efforts have been made to provide a simple and inexpensive box-like refrigeration unit, in the nature of an attachment, that can be affixed to the exterior of old, non-refrigerated vending machines to cool and maintain the interior temperatures of the machine at a desired, low temperature. While such attachment units that can be effectively related to one or a very limited number of different makes and models of vending machines might have been made, it is my understanding and belief that no such unit has previously been made that is such that it can be satisfactorily and effectively related to a sufficiently large number of the many different makes and models of old vending machines to warrant or justify entering into regular manufacture and sale thereof. The reason for the foregoing resides in the fact that, though the exterior cabinets of vending machines are substantially standardized box-like structures, the interior structure and design of the many different makes and models of old machines varies widely and is such that there are relatively few different makes and models or machines in which air inlet and outlet ports can be located in similar locations and/or in similar patterns, in the cabinets of the machines, to attain effective communication with a single design of refrigeration unit positioned at the exteriors of the cabinets whereby efficient circulation of cool air into, through and thence out of the machines can be attached.

In accordance with the foregoing, the need and want for a substantially universal attachment-type refrigeration unit that can be effectively attached and related to the great majority of different makes and models of old, non-refrigerated vending machines that are now in regular use has not been satisfied by the prior art.

OBJECTS AND FEATURES OF MY INVENTION

It is an object of my invention to provide a novel refrigeration unit that can be easily and quickly attached to the great majority of the many different makes and models of non-refrigerated, coin-operated vending machines that are now in use; and, a unit which operates to effectively and efficiently cool the interiors of those machines with which it is related so that temperature-sensitive, fragile, food items can be satisfactorily vended thereby.

An object and features of my invention is to provide a novel refrigeration unit of the general character referred to above that includes air delivery and air return chambers with open sides having large effective cross-sectional area and that oppose and are closed by a cabinet panel of a related vending machine whereby that air delivery ports and air return ports establishing communication between delivery and return chambers in the unit and the interior of the machine cabinet can be established in the panel of the machine in selected positions to effect efficient movement of air from the unit into and through the cabinet and thence from the cabinet into the unit.

It is another object and feature of the present invention to provide a refrigeration unit of the general character referred to above that includes a box-like sheet metal base with an open side that opposes a panel of a related vending machine and in which a partition is arranged to define air delivery and return chambers.

Yet another object and features of my invention is to provide a refrigeration unit of the general character referred to above wherein the noted base has air intake and air outlet openings communicating with the delivery and return chambers and positioned at the opposite, upstream and downstream sides of an evaporator coil mounted on the exterior of the base and within a thermally insulated case carried by the base; said case cooperates with the evaporator coil to define air intake and return compartments with which the intake and return openings communicate; and, a refrigeration unit wherein the evaporator coil includes a power-driven fan to move air from the return chamber through the intake opening into the intake compartment, through the evaporator coil into the return compartment, and thence through the return opening into the delivery chamber.

It is still another object and feature of the invention to provide a refrigeration unit of the general character referred to above that includes a compressor; a condensing coil with a power-driven air-circulating fan; a filter-drier; and, condensate collecting and disposal means; each carried by the base and operatively connected with each other.

Finally, it is an object and feature of the invention to provide a refrigeration unit of the general character referred to above that includes conformable sealing means to seal between the base and a panel of a related vending machine; thermal insulating means within the base; and, an exterior housing protecting and obscuring the base and those elements and parts of the unit that are carried thereby.

The foregoing and other objects and features of the invention will be apparent and will be fully understood from the following detailed description of one preferred form and embodiment of the invention, throughout which description reference is made to the accompanying drawings.

DESCRIPTION OF THE DRAWINGS

FIG. 10 is an isometric view showing the front, top and one side of the condensing coil;

FIG. 11 is an isometric view showing the top, rear and one side of the condensing coil;

FIG. 12 is an isometric view showing the top, one side and an end of the evaporator coil;

FIG. 13 is an isometric view showing the top, other side and an end of the evaporator coil;

FIG. 14 is an isometric view showing the top, one side and one end of the condensate evaporator;

FIG. 15 is an enlarged sectional view taken as indicated by line 15—15 of FIG. 14; and, FIG. 16 is an enlarged sectional view taken as indicated by line 16—16 on FIG. 14.

DETAILED DESCRIPTION OF THE INVENTION

Figure 1:
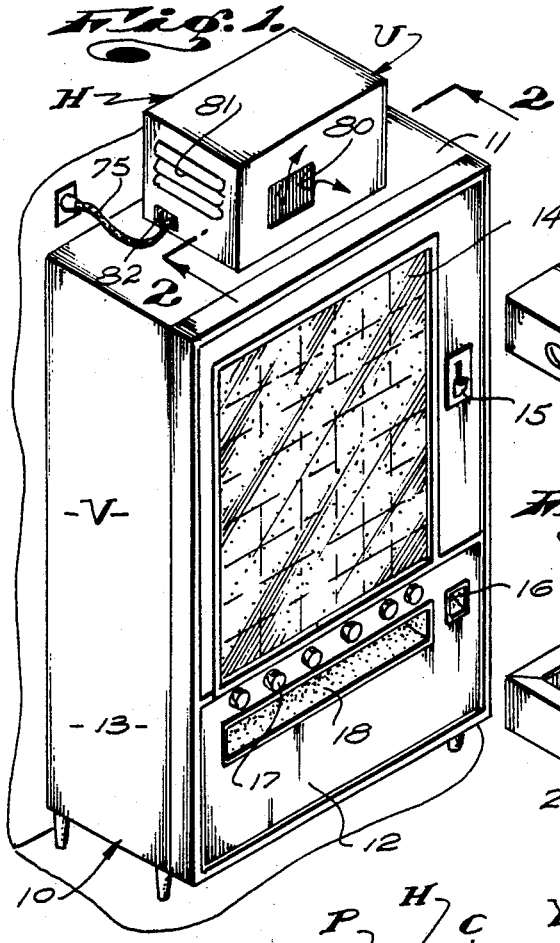
FIG. 1 is an isometric view of a vending machine with the refrigeration unit related to it.

In FIG. 1 of the drawings, I have illustrated a coin-operated vending machine V of that general type and/or class of machine here concerned with and have shown my new refrigeration unit U related to it.

The machine V that I have elected to illustrate is of no particular make or model and is only intended to show the basic parts and/or portions of a typical machine structure with which my new unit can be advantageously related.

The machine V is characterized by an exterior, rectilinear box-like cabinet 10 with a flat, horizontal top panel 11 and vertical front and side panels 12 and 13. In addition to the foregoing, the cabinet has a rear and a bottom panel (not shown). In accordance with common practice, the cabinet establishes a closed and substantially sealed interior space in which the coin and product-handling mechanisms (not shown) of the machine are contained. The front panel 12 is shown as having a window opening 14 in which items to be dispensed are displayed; coin-receiving and return slots or openings 15 and 16; manually engagable product selecting and actuating knobs 17; and, a product delivery slot 18. The most common standard feature of the great majority of existing vending machines of the type and/or class here concerned with is the basic rectilinear box-like form of the machine cabinets. While machines constructed to handle and vend different numbers of items may vary substantially in width, the difference in height and depth of the great majority of different makes and models of vending machines varies only slightly. The foregoing is understood to be the result of building codes and standards that have, to a great extent, dictated and limited that space that is provided in most building structures and the like to accommodate vending machines.

It is to be noted that the front panels of most vending machines of the class here concerned with are hinged closures in the nature of doors that can be pivoted open to provide access to the interiors of the machines in the normal course of servicing and maintaining them.

The top panels of vending machine cabinets are typically flat, horizontal metal panels that overly and close the interior space defined by the cabinets and in which the item storing, transporting and dispensing mechanisms are housed.

In the great majority of the existing vending machines of the class here concerned with the top panels 11 of the cabinets are flat, horizontal, sheet metal panels greater than 17 inches deep and in excess of 30 inches wide. The top surfaces of those panels are unobstructed while the bottom surfaces thereof are often directly engaged by and/or are in close proximity with related substructures consisting of metal frame members; mounting brackets and the like which are provided to orient and support the vending mechanisms within the cabinets and/or by parts of those vending mechanisms. The number, size, shape and arrangement of the substructure parts that occur in close proximity to the bottom surfaces of the top panels 11 of each make and model of vending machine varies (in varying degree) from the number, size, shape and arrangement of such parts in the great majority of other makes and models of machines. The noted substructure parts are such that if clear openings are to be provided in the top panels 11 for the purpose of circulating air into and out of the cabinets, the location of those openings is dictated by the number, arrangement and size of the substructure parts and is such that those openings establish in each make and model of machine must be positioned different from the position of similar openings in the great majority of other makes and models of machines.

Figure 2:
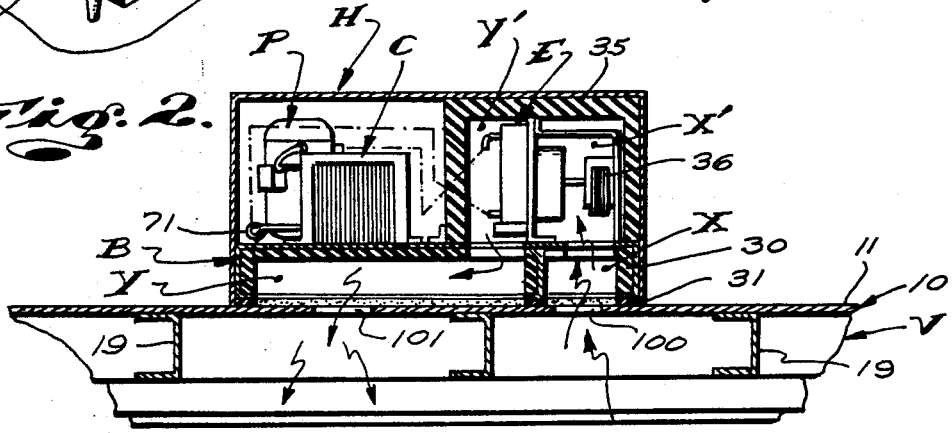
FIG. 2 is an enlarged sectional view taken substantially as indicated by line 2—2 on FIG. 1.

In FIG. 2 of the drawings, which is a sectional view through the top portion of the cabinet 10 of the machine V, I have shown a plurality of substructure parts 19 adjacent the bottom surface of the top panel 10. The parts 19 are structural parts which are not unlike substructure parts that are likely to be found in most vending machines and are only intended to graphically illustrate the interference and/or obstruction such parts create at and adjacent the bottom surface of the top panels of such machines.

In addition to obstructing and, in effect, "segmenting" the bottom surface of the top panel 10, the parts 19 and other like parts act as air baffles in the upper portions of the cabinet and their number, size, shape and extent must be taken into careful consideration if and when forced circulation of air within the cabinet is sought to be established.

Since the mechanical means and devices within the cabinets of machines of the class here concerned with are well-known to those skilled in the art, vary widely in form and construction, and do not effect the novelty and spirit of my invention, I have elected not to unduly burden this disclosure with unnecessary illustration and description thereof.

The refrigeration unit U that I provide is a box-like unit and is mounted on and projects up from the top surface of the top panel 11 of the vending machine cabinet 10; as clearly shown in FIGS. 1 and 2 of the drawings.

Figure 3:
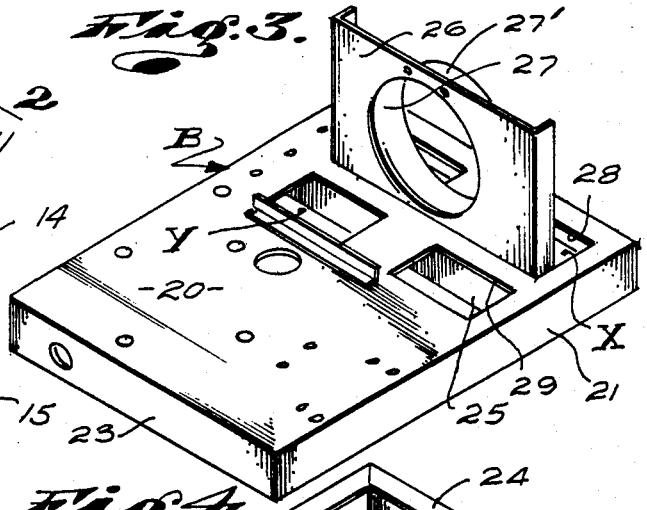
FIG. 3 is an isometric view showing the top, front and one end of the base.
Figure 4:
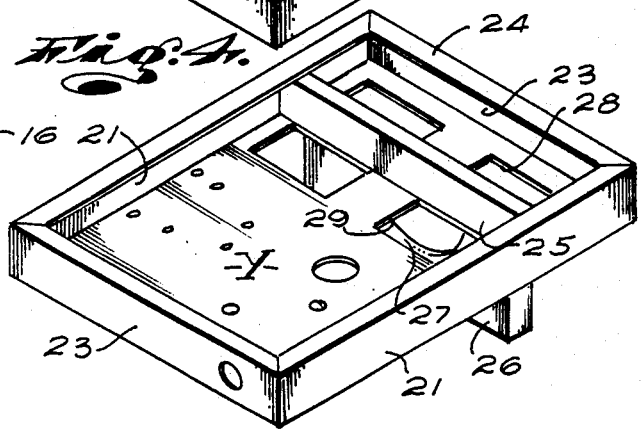
FIG. 4 is an isometric view showing the bottom, rear and one end of the base.

The unit U is a fabricated assembly of parts and, first, includes a flat, horizontal, downwardly-opening box-like base B (see FIGS. 3 and 4 of the drawings). The base B has a flat, rectangular, horizontal top wall 20, vertical front, rear and side walls 21, 22 and 23 about the perimeter of and depending from the top wall 20 and flat, horizontal support flanges 24 projecting inwardly from the lower edges of the noted side walls. The base B further includes a vertical, transversely extending partition 25 that divides the interior of the base to establish or define an air-receiving chamber X and an air delivery chamber Y. The partition 25, like the vertical walls of the base, is formed with a support flange 24' at and along its lower edge.

It is to be noted that the chambers X and Y open downwardly and, together, are substantially coextensive with the horizontal plane of the base. Further, the dimensional and effective open cross-section or bottom area of each chamber X and Y is substantial or great.

In addition to the above, the base includes a vertical partition or wall 26 that is preferably fixed to and projects upwardly from the top wall 20 above or in close proximity to the partition 25. The wall 26 is formed with a horizontal air passage 27. The air passage 27 can be and is preferably defined by an annular fan cowling 27', as clearly shown in the drawings.

The base B is next characterized by and includes vertical air-receiving and delivery ports 28 and 29 formed in the top wall 20 at opposite sides of the partition 25 and wall 26 and that open at the tops or upper portions of the chambers X and Y.

In addition to the foregoing, the top and one or more of the several vertical walls of the base structure are formed with suitable and appropriate openings through which those electric current and fluid-conducting lines which are included and go to make up the refrigeration system of the unit can be most effectively and advantageously extended and into which the various screw fasteners and the like utilized to fabricate the refrigeration unit can be entered. Since the number, size and location of the above-referred-to openings can be varied as one might desire without in any way affecting the novelty of my invention, further detailed description thereof will be avoided. It is to be understood that in the following, where description reference is made to lines extending from one part of the structure to another, those lines, when necessary or appropriate, extend through openings provided in the base structure to accommodate them.

Figure 8:
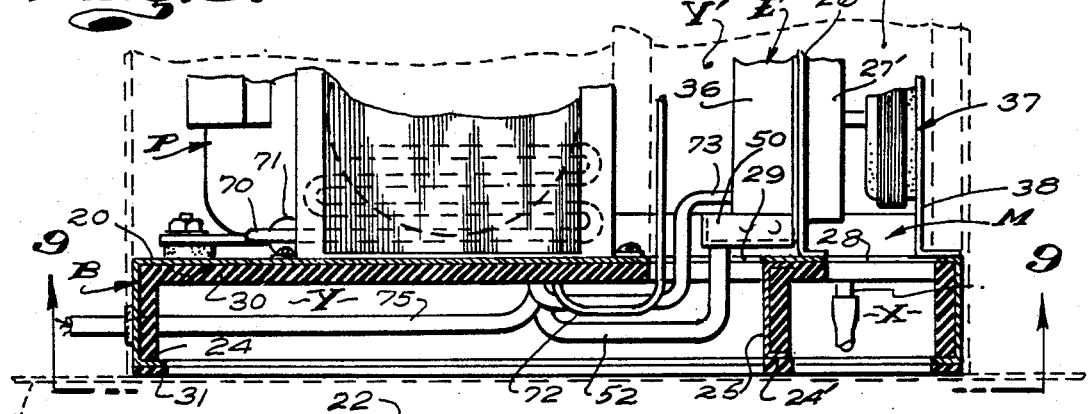
FIG. 8 is a sectional view taken substantially as indicated by line 8—8 on FIG. 7.

Next, in the preferred carrying out of the invention, the several interior surfaces of the several walls and the partition defining the chambers X and Y have fixed thereto and carry panels or sheets of thermal insulation 30 that effectively serve to thermally insulate the chambers (see FIGS. 2 and 8 of the drawings). In practice, any one of numerous suitable insulating materials can be used.

Figure 9:
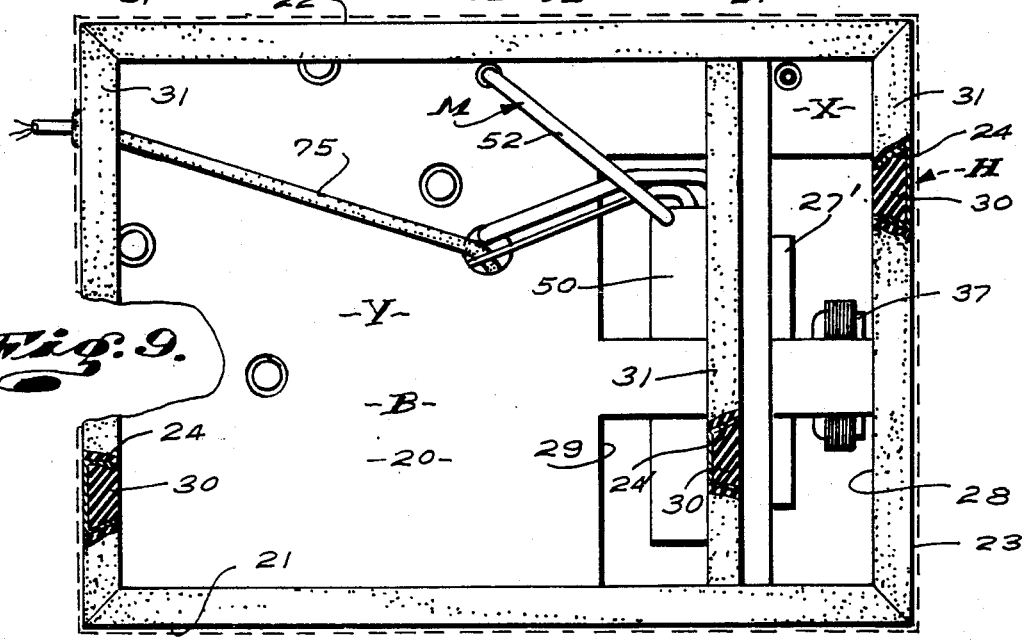
FIG. 9 is a bottom plan view taken as indicated by line 9—9 on FIG. 8.

Finally, as shown in FIGS. 2, 8 and 9 of the drawings, the base B includes sealing means 31 to seal between the support flanges 14 and 14' of the base and the top surface of the top panel 11 of the vending machine M with which the unit is related. The sealing means preferably include thick, rubber-like strips of soft, resilient, foamed synthetic rubber, such as Neopren. The sealing means, or rubber sealing strips, are cemented onto the bottom surfaces of the flanges 14 and 14' and are of sufficient thickness and are sufficiently soft so that when urged into engagement with the top surface of the top panel 11, they readily conform to any irregularities in the panel and assure the establishment of an effective substantially air-tight seal therebetween.

Figure 5:
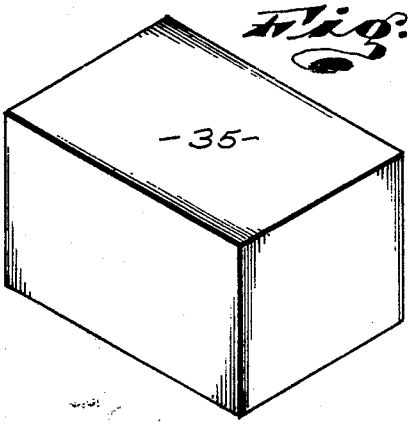
FIG. 5 is an isometric view showing the top, front and one end of the chamber case.
Figure 6:
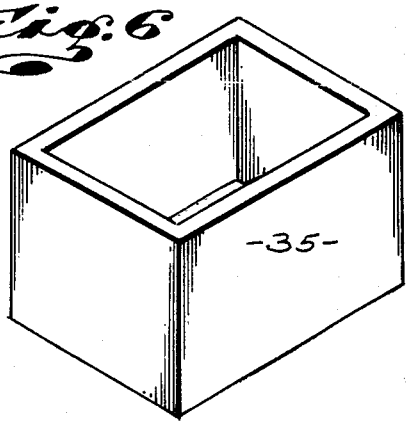
FIG. 6 is an isometric view showing the bottom, rear and one end of the chamber case.
Figure 7:
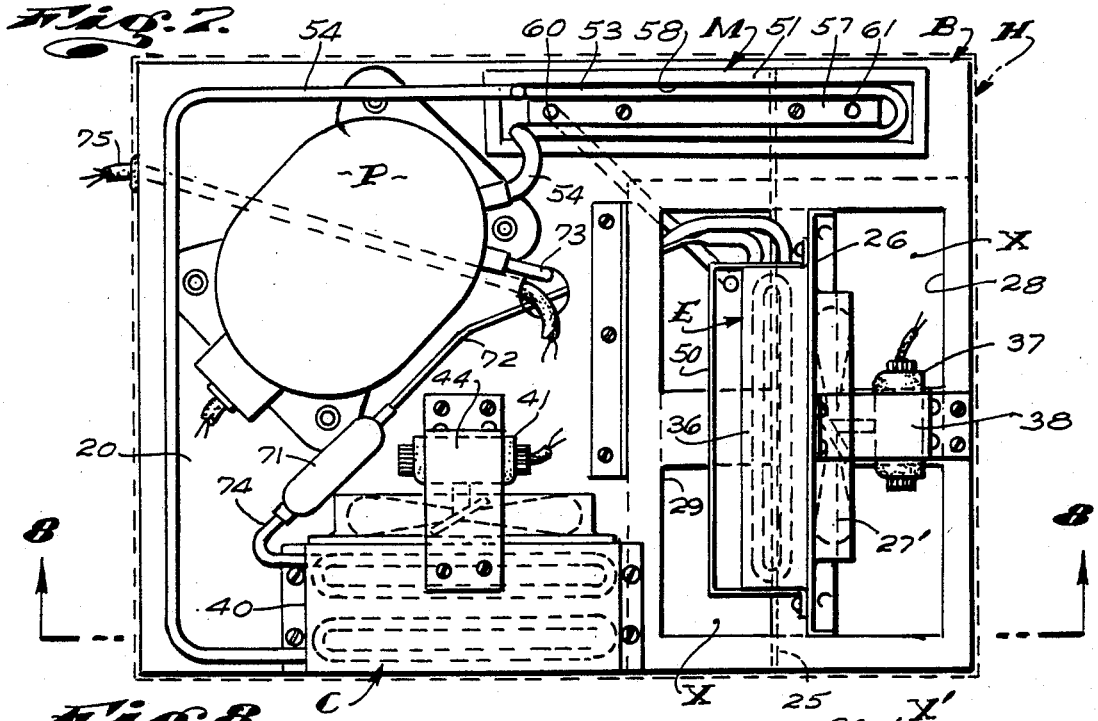
FIG. 7 is a top plan view of the refrigeration unit.

The refrigeration unit U next includes a downwardly-opening box or case 35 (see FIGS. 5 and 6 of the drawings). The case 35 is arranged or positioned over the vertical wall 26 of the base and over the ports 28 and 29 with its lower rim in supported sealing engagement with the top surface of the top wall 20.

The vertical wall 26 extends vertically and transversely in the interior of the case and fits snugly therein to divide the interior of the case and define an air intake or upstream compartment X' and an air outlet or downstream compartment Y' at upstream and downstream sides of the wall 26 and with which the openings 28 and 29 communicate.

In practice, the compartments X' and Y' are preferably thermally insulated. Accordingly, in the preferred form of the invention, the case 35 is molded or fabricated of panels of suitable thermal insulating materials, such as foamed polystyrene.

In practice, and as shown, the base B can be provided with orienting and retaining flanges or the like to orient and releasably maintain the case 35 in desired set position atop the base.

The refrigeration unit U next includes a flat, vertical evaporator coil E with upstream and downstream sides. The coil E is fixed to the vertical wall 26 of the base and overlies the passage 27 therein as clearly shown in FIGS. 2, 7, 8, 12 and 13 of the drawings. Coil E can vary widely in details of construction and, for the purpose of this disclosure, is shown as having a sheet metal frame 36 about its perimeter. The sheet metal frame has mounting flanges that are screw fastened to the wall 26.

In addition to the above, I provide air-moving means in the form of an electric-powered fan unit 37 to move air through the coil E from the upstream to the downstream side thereof. For the purpose of this disclosure, the fan unit 37 can and will be considered an element or part of the evaporator coil assembly.

In the form of the invention illustrated, the coil E occurs within the compartment Y' and is fixed to the downstream side of the wall 26. The motor-driven fan unit 37 is mounted within the compartment X' by a suitable mounting bracket 38 fastened to the top wall 20 and the vertical wall 26. The fan unit 37 is disposed with its fan 39 within the opening 27 or within the opening cowling that defines that opening and so that when the fan is operated, it forcibly moves air from the compartment X' through the opening 27 and the coil E into the compartment Y'.

At this time it is appropriate to note that the fan unit 37 also induces and maintains a constant flow of air from the chamber X through the port or ports 28 in the top wall 20 into the compartment X' and from the compartment Y' through the port or ports 29 in the top wall of the unit into the chamber Y.

The refrigeration unit U next includes a flat condensing coil C (see FIGS. 2, 7, 8, 10 and 11 of the drawings). The coil C has upstream and downstream sides and is positioned atop the top wall 20 of the base B remote from the case 35. The coil C is positioned with its downstream side disposed toward and preferably adjacent one exterior side or surface of the unit U. In the case illustrated, the coil C is mounted on the top wall 20 adjacent the front edge thereof with its downstream side disposed forwardly.

The coil C, like the coil E, is shown provided with an exterior sheet metal frame 40 with mounting flanges that are screw fastened to the top wall 20.

The coil C, like the coil E, includes, or has related to it, a motordriven fan unit 41 to forcibly move air from the upstream side of the coil, through the coil and outward from the downstream side thereof. The fan unit 41 preferably includes and is shown as having a fan cowling plate 42 with an annular fan cowling 43 fastened to and overlying the downstream side of the coil C. The unit 41 next includes a mounting bracket 44 for the motor of that unit and which is fixed to and extends between the base B and the frame 40 of the coil. The unit is mounted as disclosed so that its fan 45 occurs within the cowling 43 and so that when the unit is operating, it forcibly moves air through the coil C.

It is to be noted that the coil C can be positioned and arranged adjacent the back side or an end of the unit or can, if desired, be mounted and arranged with its downstream side disposed vertically and positioned adjacent the top of the unit without departing from the broader aspects and spirit of my invention.

My new refrigeration unit U next includes a standard or conventional pump or compressor unit P that is fastened to and projects upwardly from the top wall 20 of the base by means of suitable shock fastener means. The pump or compressor P is spaced from the case 35 and the coil C as clearly shown in FIGS. 2, 7 and 8 of the drawings.

The unit U next includes a condensate (water) disposal means M that functions to collect condensate at the coil E and dispose of it in the form of vapor. The means M includes a drip tray 50 positioned below and carried by the coil E, an evaporator tray 51 mounted atop the top wall 20 of the base B and connected with the tray by a drain line 52. The evaporator tray includes a heater tube 53, through which heated or hot refrigerant is conducted and which heats condensate delivered into the tray and causes it to evaporate. The tube 53 is connected with and between portions of a high pressure refrigerant line 54 extending between a discharge side of the compressor P and an inlet for the coil C. Alternatively, the tube 53 could be established by a portion of the line 54.

The evaporator tray 51 is a flat, horizontal block-like body formed of a plastic material having a low coefficient of heat conductivity. That is, the tray is thermally insulated. The tray 51 has a flat, top surface 55 and has a shallow, upwardly opening overflow basin 56 with a flat, bottom surface 57 entering the surface 55. The tray next includes an elongate, upwardly-opening heater-tube-receiving evaporator channel 58 entering the bottom surface 57 of the basin and extending about the outer perimeter of the basin. The channel 58 is substantially equal in depth with the outside diameter of the tube 53 so that the tube, which is entered into and extends longitudinally of the channel, is substantially wholly within the channel and below the bottom 57 of the basin. The ends of the tube 53 project up from the tray 51 where they connect with related sections of the line 54. The waste line extending from the drip tray 50 is connected with an inlet port 60 entering the bottom surface 57 of the base 56, as clearly shown in the drawings. Finally, the tray has an overflow port 61 entering the bottom surface 57 of the basin and with which a waste line 62 is suitably connected. The line 62 is preferably an elongate, flexible rubber or plastic tube that can be advantageously extended down through the interior of or behind the cabinet 10 of the vending machine V (to the ground or to a waste pipe) for most effective disposal of waste water.

In operation and when condensate at the coil E is collected by the drip tray 50, the collected water drains into the basin 56 of the tray 51 and is spread or caused to flow into the channel 58 where it is heated by the tube 53 and is caused to evaporate. The tube 53 is heated by the hot refrigerant delivered into it from the pump or compressor P. If the volume and rate of condensate delivered to the tray 51 exceeds the volume and rate at which the condensate can be evaporated, the excess condensate floods the basin 56 and is drained therefrom through the port 61 and line 62.

In addition to the foregoing, the refrigeration unit U includes the above-noted refrigerant line 54 that extends from the compressor P to the coil C; and outlet line 70 extending from the coil C to the filter-drier 71; a capillary tube 72 extending from the accumulator 71 to the evaporator coil E; and, a return line 73 extending from the coil E to the inlet side of the compressor P. The end of the tube 72 at the coil E has or defines an expansion valve or nozzle. In addition to the foregoing, the unit U also includes an electric power service cord 75 that extends from a suitable remote service outlet to the unit U where it enters that unit and is suitably connected with the compressor P and the fan units 36 and 41 by appropriate secondary conductor lines, in accordance with common and accepted practices. As previously noted, the several tubes, lines and cord and preferably laid out in a most effective and neat manner and the various sheet metal and/or plastic parts of the structure are suitably ported and/or formed with openings to accommodate those lines and cords.

Finally, my new refrigeration unit includes a suitable housing H that is removably engaged about the base B and overlies those components and parts of the unit that are carried by and project upwardly from the base. In the form of the invention shown (see FIGS. 1 and 2 of the drawings), the housing H is a simple downwardly-opening box-like sheet metal unit that overlies the base and which has a lower end portion that is slidably engaged about the several vertical sides of the base. The housing H has an exhaust opening 80 that registers with the downstream side of the coil C; air intake vents or slots 81 that allow for free entry of air into the interior of the housing and, as shown, is provided with a notch 82 to accommodate the power cord 75. The primary purpose of the housing H is to protect the remainder of the structure over and about which it extends and to enhance the appearance of the unit. In practice, the shape and construction of the housing H can be varied to meet the reasonable demands of purchasers of the unit without affecting the broader aspects and spirit of my invention.

When my new unit is put to use in its intended environment, that is, when it is cooperatively related to its related vending machine V, the unit is first set atop the top panel 11 of the machine and the area of that panel which it will occupy is suitably noted or marked. Thereafter, the unit is removed from the machine and the location of obstructive substructure parts 19 below the top panel 11 is noted. Thereafter, one or more air delivery openings 100 are made in the panel 11 in unobstructed parts or portions thereof to open at and communicate with the chamber Y of the base B; and, one or more air return openings 101 are made in unobstructed portions of the panel 11 to open at and communicate with the chamber X of the base. Thereafter, the unit U is returned to its predetermined set position atop the panel 11 and is ready to be connected with its power source and to be put into operation and regular use.

When in operation and use, the fan unit 31 causes air to move from the chamber X into the compartment X', through the coil E into the compartment Y', and thence from the compartment Y' into the chamber Y. The movement of air into the chamber Y advances air through the opening or openings 100 in the panel 10 into the machine V where it circulates down and then up in the machine to where it is returned through the opening or openings 101 into the chamber X in the base for recycling or recirculation in and through the unit U and the machine V.

In practice, the base B and/or the housing A can be releasably secured to the top panel 11 of the machine V by any suitable latch and/or locking mechanism.

Further, in practice, the unit U can be operated continuously or intermittently by plugging or unplugging the service cord into its related service outlet. Alternatively, an on and off switch might be provided at the service outlet, in the service cord or in the unit U, to start and stop operation of the unit. Still further, the unit U can be connected with and put under control of an adjustable temperature-responsive switching device to switch the unit on and off as desired. Such a switching device can be within the machine V, within the unit U, or at the exterior of the machine and the unit and operatively related to the power cord as circumstances require or as the user of the unit might desire, without departing from the broader aspects and spirit of my invention.

It is important to note that the effective cross-sectional area of the ports opening at the tops of the chambers X and Y is a small fraction of the cross-sectional area of the open bottoms of those chambers; and, that the effective cross-sectional area of the openings 100 and 101 in the panel need be no greater than and are preferably the same in area as the ports; and, that the openings can be positioned anywhere in the panel where they open to their related chambers. Accordingly, wide latitude is afforded to the positioning of the openings in the panel.

Having described only typical preferred form and embodiment of my invention, I do not wish to be limited to the specific details herein set forth but wish to reserve to myself any modifications and/or variations that might appear to those skilled in the art and which fall within the scope of the following claims.

Having described my invention, I claim:

1. In combination, a coin-operated vending machine having a boxlike cabinet with at least one panel with a flat surface; a box-like refrigeration unit with an open side removably positioned adjacent the exterior surface of the panel; the refrigeration unit has air-receiving and air delivery chambers with open sides at the open side of the unit and that together are substantially coextensive with said open side of the unit and that are disposed toward the panel and are closed thereby, the panel has air delivery and air return openings communicating with the delivery and return chambers and with the interior of the cabinet, the unit has a case defining air intake and air outlet compartments, an air intake port communicates with the air-receiving chamber and intake compartments, an air outlet port communicates with the air delivery chamber and the air outlet compartment, an evaporator coil with upstream and downstream sides is positioned in the case with its upstream and downstream sides disposed toward the intake and outlet compartments, a motor-driven fan unit in the case forcibly moves air from the intake compartment through the evaporator coil into the outlet compartment, a motor-driven compressor at the exterior of the chambers and compartments has an inlet connected with an outlet of the evaporator coil, a condensing coil at the exteriors of the chambers and compartments and between an outlet of the compressor, and an inlet of the evaporator coil; and, power supply means is connected with the compressor and fan unit.

2. A refrigeration unit to be attached to a flat panel of a related cabinet and to recirculate and cool air within the cabinet; said unit includes a box-like base with a flat, horizontal top wall, vertical front, rear and side walls, and a vertical partition beneath the top wall and between opposite side walls and defining a downwardly-opening air-receiving chamber and a downwardly opening air delivery chamber, the vertical walls and partition have lower edges engaging the cabinet panel, the panel overlies and closes the bottoms of the chambers, the panel has air outlet and air return openings establishing communication between the inlet and return chambers and the interior of the cabinet, the top wall has spaced air inlet and outlet ports establishing communication between the air-receiving and air delivery chambers and related air intake and outlet compartments defined by a case positioned atop the top wall, an evaporator coil is positioned in the case between the compartments, a motor-driven fan unit is positioned adjacent and forcibly moves air from the intake compartment through the evaporator coil into the outlet compartment, a return line is connected with an outlet of the evaporator coil and an inlet of a compressor supported by the base, a condensing coil is supported by the base, a delivery line is connected with an outlet of the compressor and an inlet of the condensing coil; and, a flow tube is connected with an outlet of the condensing coil and an expansion nozzle at the inlet of the evaporator coil.

3. The refrigeration unit set forth in claim 2 wherein the case is a downwardly opening thermally insulated box with a rim in supported sealed engagement with the top wall.

4. The refrigeration unit set forth in claim 2 and which further includes a motor-driven fan positioned adjacent and moving air through the condensing coil.

5. The refrigeration unit set forth in claim 2 wherein the case is thermally insulated and said lower edges thereof are in sealed engagement with said top wall, an appertured vertical wall projects up from the top wall into the case and defines said compartments, the evaporator coil is positioned at and overlies the apperture in the vertical wall.

6. The refrigeration unit set forth in claim 2 and which further includes a filter-drier connected in the flow tube between opposite ends thereof.

7. The refrigeration unit set forth in claim 2 and which further includes a box-like housing engaged about and projecting up from the base and which shrouds the parts of the unit atop the base.

8. The refrigeration unit set forth in claim 2 and which further includes a box-like housing engaged about and projecting up from the base and which shrouds the parts of the unit atop the base; the housing has air intake openings and an air exhaust opening, said condensing coil is positioned adjacent and overlies the exhaust opening, a motor-driven fan moves air into the housing through the intake opening and out of the housing through the evaporator coil and the exhaust openings.

9. The refrigeration unit set forth in claim 2 and which further includes a box-like housing engaged about and projecting up from the base and which shrouds the parts of the unit atop the base; the housing has air intake openings and an air exhaust opening, said condensing coil is positioned adjacent and overlies the exhaust opening, a motor-driven fan moves air into the housing through the intake opening and out of the housing through the evaporator coil and the exhaust openings; and condensate disposal means including a drip tray below the evaporator coil, an evaporator tray atop the base and defining an upwardly opening overflow basin with a flat upwardly disposed bottom and an elongate upwardly opening channel entering said bottom, an elongate heater tube is arranged within the channel and occurs below said bottom and is connected in the delivery line between the ends thereof, a drain line extends from the drip tray to the basin and conducts condensate from the drip tray into the basin and the channel, an overflow port opens at the bottom of the basin and connects with an elongate waste line.

* * * * *